United States Patent [19]

Goettl et al.

[11] 4,212,088

[45] Jul. 15, 1980

[54] APPARATUS FOR CLEANING SWIMMING POOLS

[75] Inventors: John M. Goettl, Phoenix, Ariz.; George J. Ghiz, 4736 E. Palo Verde, Phoenix, Ariz. 85018

[73] Assignee: George J. Ghiz, Phoenix, Ariz.

[21] Appl. No.: 907,113

[22] Filed: May 18, 1978

Related U.S. Application Data

[60] Division of Ser. No. 832,464, Sep. 12, 1977, abandoned, which is a continuation-in-part of Ser. No. 616,677, Sep. 25, 1975, abandoned.

[51] Int. Cl.[2] ..... E04H 3/20; B08B 3/02; B05B 15/10

[52] U.S. Cl. ..... 4/490; 134/167 R; 239/66; 239/204

[58] Field of Search ..... 4/1, 145, 172, 172.15, 4/172.16, 172.17, 146, 178; 134/167 R, 168 R; 239/66, 67, 204, 206, 240, 251, 203, 205; 210/169

[56] References Cited

U.S. PATENT DOCUMENTS

| | | | |
|---|---|---|---|
| 2,509,076 | 5/1950 | Royer | 239/240 X |
| 2,924,174 | 2/1960 | McLean | 239/251 |
| 3,117,724 | 1/1964 | Ray | 239/206 X |
| 3,408,006 | 10/1968 | Stanwood | 239/66 |
| 3,449,772 | 6/1969 | Werner | 134/167 R |
| 3,506,489 | 4/1970 | Baker | 210/169 X |
| 3,675,252 | 7/1972 | Ghiz | 4/172.17 |
| 3,782,630 | 1/1974 | Sabo | 239/206 X |

*Primary Examiner*—Stuart S. Levy
*Attorney, Agent, or Firm*—Cahill, Sutton & Thomas

[57] ABSTRACT

The disclosure relates to a method and apparatus for swimming pool cleaning incorporating intermittent pop-up jet rotated nozzles; the nozzles being adapted to intermittently rotate and project cleaning jets of water adjacent said inner surface. The nozzles each have eccentrically positioned tangential water outlets forming jet outlet passages; the nozzles are vertically reciprocal and are rotatably mounted in housings having stop means such that when they are hydraulically energized by water under pressure in the housings, the nozzles emerge from the upper ends of the housings and cause jet reaction rotation thereof during upward movement which is arrested by the stop means in the housing. The housing includes a bore with clearance around the nozzle so as to provide a water bearing around the nozzle during its upward and rotative movement. A plurality of such nozzles are disposed in a swimming pool and the nozzles are successively and sequentially hydraulically energized by water under pressure from a sequencing valve which receives water from a water pump which in turn receives water from the pool.

6 Claims, 7 Drawing Figures

APPARATUS FOR CLEANING SWIMMING POOLS

This is a division of application Ser. No. 832,464, filed Sept. 12, 1977; now abandoned, which is a Continuation-In-Part of application Ser. No. 616,677, filed Sept. 25, 1975; now abandoned.

The invention pertains to a method and apparatus for cleaning swimming pools and more particularly, to a method and apparatus for directing high pressure streams of water along the inner surfaces of the pool bottom and walls to cause a scrubbing action and loosen dirt and sediment adhering thereto.

Various jet means have been used successfully to clean the inner surfaces of swimming pools. Some of these jet reaction devices have included jet tubes of flexible nature which have been capable of sinusoidal action in response to jet efflux from the ends of the tubes. Other jet means in swimming pools have been motor operated water jets which rotate and cause water jet sweeping of the surface of the pool around each respective jet nozzle. Some of these devices require gear trains in order to attain sufficient torque from water pressure so as to reliably rotate; such systems have been relatively expensive as a result of the requirement for turbine operated reduction gears for rotating the nozzles. Furthermore, such systems generally require substantial maintenance and are relatively difficult to install during the construction of swimming pools.

Accordingly, it is an object of the present invention to provide a method and apparatus for more effectively cleaning the interior surface of a swimming pool by directing streams of water along the interior surfaces in a unique manner.

It is another object of the present invention to provide a method of cleaning the interior surfaces of a swimming pool that more efficiently cleans the pool at a lower cost than prior art cleaning methods.

It is another object of the invention to provide a very efficient pool cleaning system employing novel randomly rotated nozzles which are rotatably and axially moveable in housings in the bottom of the pool and in flush relation therewith when not energized.

Another object of the invention is to provide a very simple jet reaction nozzle means which may be disposed in the bottom of a swimming pool to issue jets of water along the inner surface thereof and whereby a plurality of such nozzles disposed in an array in the bottom of the pool not only effect cleaning of the bottom of the pool but also have sufficient jet power to cause efficient cleaning flow up the sides of the pool.

Another object of the invention is to provide a novel jet rotated nozzle which operates in a water bearing of minimum friction and which is sequentially energized by a sequencing valve receiving water under pressure from a water pump and whereby a plurality of such nozzles are sequentially energized in a suitable geometrical array on the bottom of the pool so that the entire area of the pool is efficiently cleaned by sequential operation of such nozzles.

Another object of the invention is to provide a pool cleaning system which is very simple and economical to install in addition to its efficiency of operation.

Another object of the invention is to provide a pool cleaning system having novel jet rotated nozzles arranged in array and controlled by a sequencing valve, all of which provides unusually powerful and efficient cleaning of swimming pools.

These and other objects of the present invention will become apparent to those skilled in the art as the description thereof proceeds.

Briefly, in accordance with the embodiments chosen for illustration, the present invention incorporates a novel pop-up rotary jet nozzle means which floats in a water bearing arrangement during its pop-up motion and is provided with an eccentrically positioned tangential jet outlet so that water under pressure forces the nozzle upwardly in its respective housing while causing it to rotate as it emerges from the housing. The housing includes sufficient clearance around the nozzle so that the nozzle is completely surrounded by water which forms a water bearing during the upward and jet reaction rotation of the nozzle. A plurality of such nozzles are installed in a swimming pool in respective housings and the housings are intermittently and sequentially supplied water under pressure by a sequencing valve which receives water under pressure from a hydraulic pump which, in turn, receives water from the interior of the swimming pool. The individual nozzle structure of the invention comprises a nozzle of generally circular cross section which is both vertically reciprocally mounted and rotatably mounted about a generally vertical axis, each nozzle being contained in a separate housing with stop means to limit the upward and rotational movement of the nozzle to a position wherein its jet outlet passage is above the lower surface of the pool so as to issue a jet of water generally parallel to the surface from which the nozzle extends. The respective housings in which the nozzles are reciprocally and rotatably mounted receive water under pressure from a pump; the pump produces sufficient pressure through a conventional sequencing valve such that each nozzle is successively and intermittently hydraulically energized and receives the full force of the water pressure developed by the pump. As a result, a substantial and powerful water jet issues from each nozzle sequentially and intermittently, each nozzle sweeps a jet of water over the lower surface and walls of the pool around its particular area. The rotation of each nozzle is only intermittent; during the application of hydraulic pressure thereto, in accordance with the respective sequencing operation of the sequencing valve relative to each particular jet nozzle, each nozzle will extend from its respective housing and rotate during such extension until such extension and rotation is arrested and the nozzle is in its fully extended position. Thus, each nozzle in its turn is energized and receives water under pressure and issues a strong stream of water along the inner surfaces of the pool. The nozzles are so disposed that they take turns receiving water under pressure and each rotates during each intermittent cycle of operation as they extend from their housings thereby providing extremely efficient cleaning action of the bottom and sides of the swimming pool.

Each jet nozzle, while being energized, is projected upwardly from a generally flush position with the bottom surface of the pool to a position in which the jet outlet nozzle is exposed above the surface of the pool; during extension of the jet nozzle as it is energized, water flows therearound to hold it concentric in the bore of the housing and to provide a water bearing so that friction is minimized and thereby allow the jet reaction force to rotate the nozzle efficiently each time it is energized. When the nozzle reaches its extended position, all rotation is stopped; the amount of rotation for each succeeding energization is random, and varies so that the areas cleaned during such energization periods overlap. When the respective jet nozzle is deenergized, it gravitates downward into a flush position into the bottom of the pool; the respective housing which contains the jet nozzle is embedded in the bottom of the pool and is flush with the bottom of the pool. The housing contains a screw threaded ring which may be readily removed so as to permit removal of the respective jet nozzle from the housing. The ring also forms a stop to arrest upward and rotational movement of the respective jet nozzle. The nozzle includes an outwardly directed ledge adapted to engage in an inwardly directed structure of the aforementioned ring.

The present invention may more readily be described by reference to the accompanying drawings in which.

Figure 1:
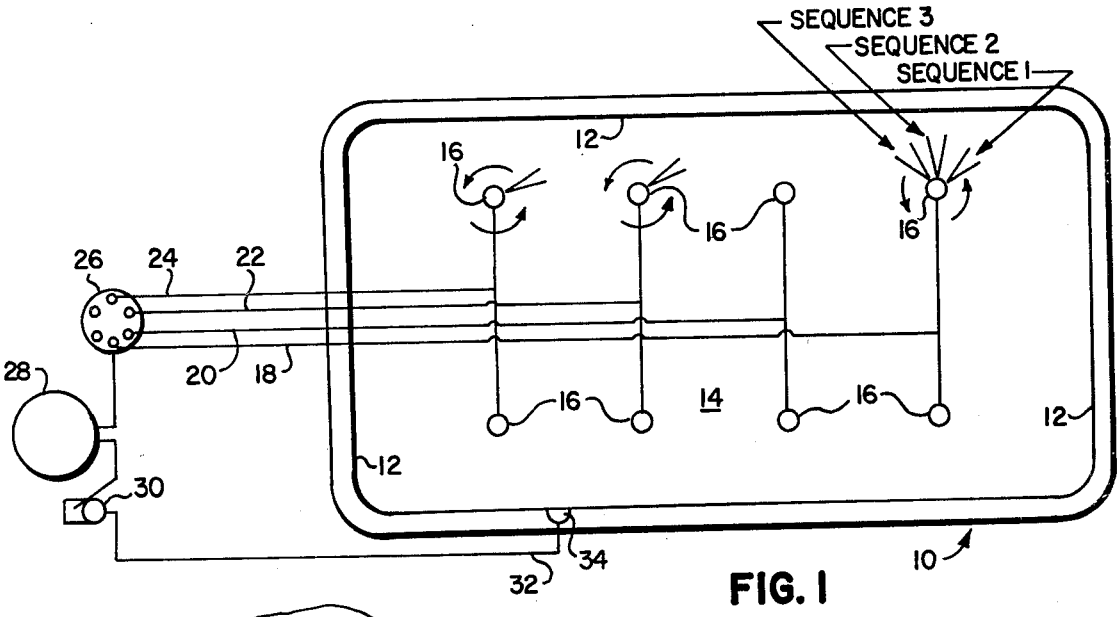
FIG. 1 is a top or plan view showing diagrammatically a swimming pool with a plurality of pop-up jet rotated nozzles therein and also diagrammatically showing plumbing connecting a sequencing valve for sequentially and hydraulically energizing the jet rotated nozzles of the invention.

As shown in FIG. 1, a swimming pool 10 is provided with generally vertical sides 12 and a bottom surface 14. A plurality of nozzle and housing assemblies 16 are embedded in the bottom of the pool and these nozzle and housing assemblies are shown in FIGS. 2 through 7 inclusive of the drawings, as will be hereinafter described in detail.

Shown diagrammatically in FIG. 1 are water conduits 18, 20, 22 and 24 which communicate with the nozzle and housing assemblies 16. The conduits 18 through 24 inclusive, communicate with a sequencing valve 26 which receives water from a filter 28; a pump 30 delivers water to the filter 28 and receives water through a conduit 32 from an area 34 in the swimming pool 10. The sequencing valve 26 sequentially energizes the nozzle assemblies 16 as will be hereinafter described in detail.

Figure 2:
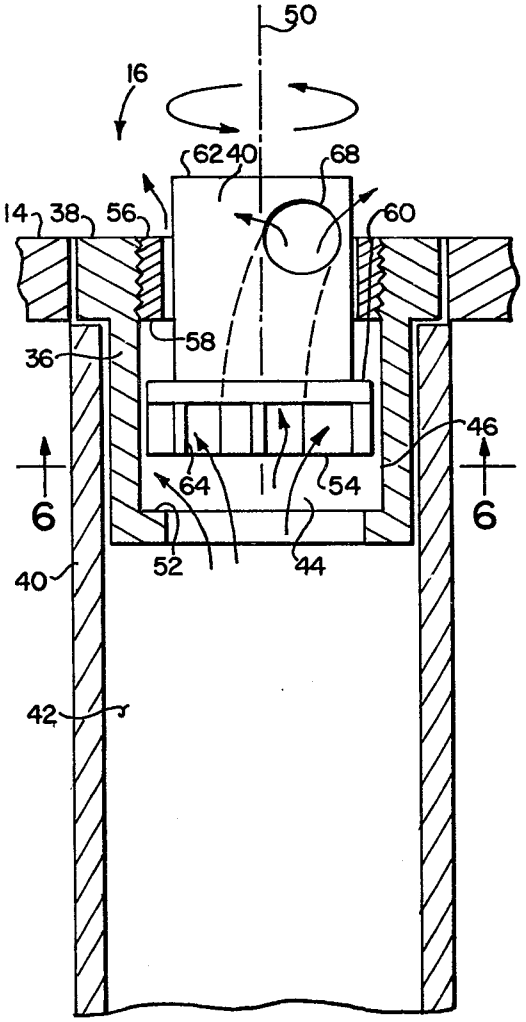
FIG. 2 is an enlarged fragmentary sectional view taken along line 2—2 of FIG. 1 and showing water flow through a housing containing one of the pop-up jet rotated nozzles and also showing the nozzle moving upwardly into jet reaction rotation position.
Figure 3:
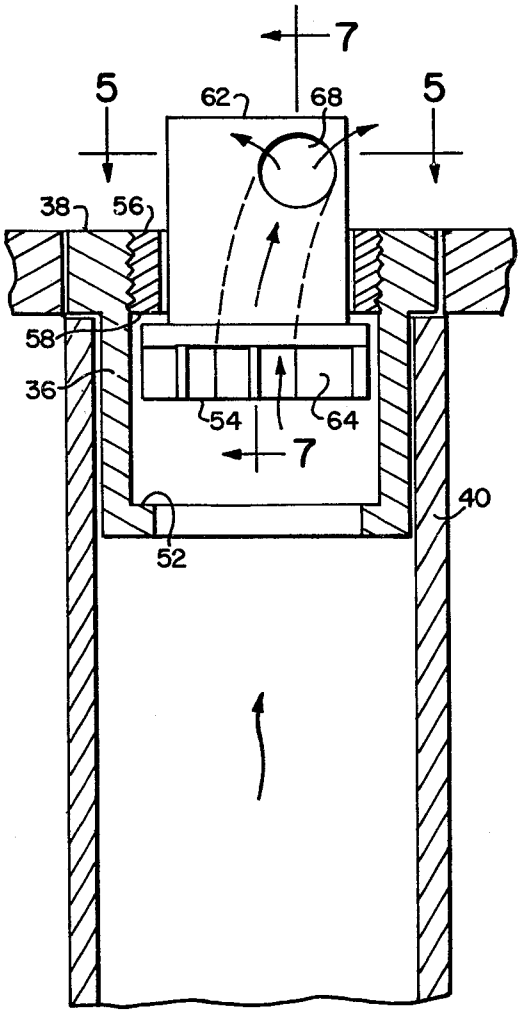
FIG. 3 is a view similar to FIG. 2 but showing the jet nozzle almost completely in an uppermost position and adjacent to the stop provided by a housing in which the nozzle is rotatably and axially moveable.

Referring to FIG. 2 of the drawings, it will be seen that each nozzle and housing assembly 16 is provided with a housing 36 having an upper open end 38 which is substantially flush with the bottom pool surface 14. Connected to the housing 36 is a conduit 40 which communicates with one of the respective conduits 18 to 24 hereinbefore described; each conduit 40 is provided with an interior 42 adapted to deliver water under pressure to the interior 44 of the respective housing 36.

The housing 36 is provided with an internal bore 46 in which a pop-up jet reaction rotated nozzle 48 is rotatably and reciprocally mounted. Each nozzle 48 is provided with a generally vertical axis of rotation 50 and is moveable upward and downward in the housing 36. Each nozzle 48 is also rotatable about the axis 50 in the housing as will be hereinafter described.

The housing is provided with an inwardly directed annular stop ledge 52 near its lower end adapted to support a lower end 54 of the nozzle 48 when in rest position. A screw threaded sleeve 56 is threadably mounted and threadably removable from an upper end of each respective housing 36 and is provided with an inwardly directed ledge 58 acting as a stop for engaging a respective radially directed ledge or collar 60 of the respective nozzle 48.

Figure 4:
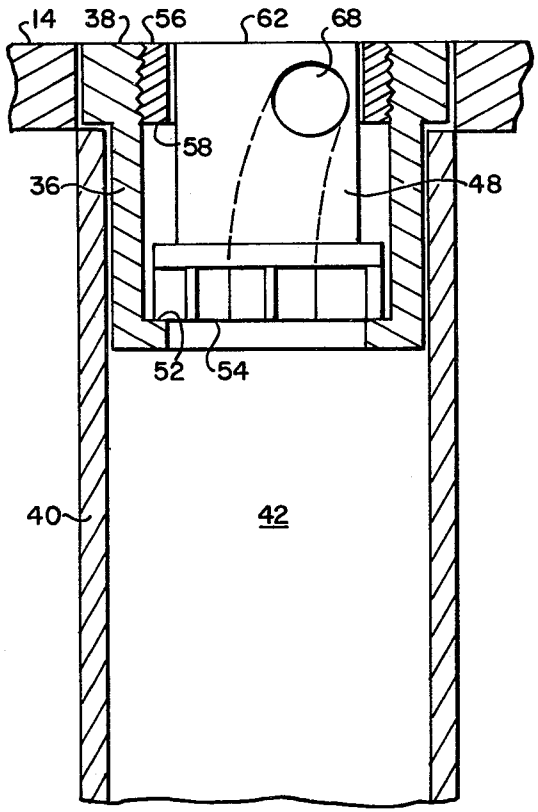
FIG. 4 is another view similar to FIG. 2 but showing the respective jet rotated nozzle in a rest position and deenergized without any water pressure in the housing and showing the nozzle in substantially flush position with the bottom of a swimming pool.

Each nozzle 48 is provided with an upper end 62 which, when at rest as shown in FIG. 4, is substantially flush with the bottom surface 14 of the pool and it will be seen that the upper end 38 of the housing 36 as well as the upper end of the screw threaded sleeve 56 are also flush with the bottom surface 14 of the pool. The cleaning system of the present invention will normally be in operation only during nighttime or periods of nonuse as determined by the pool owner. When the system is not operating, all apparatus is flush with the inner pool surfaces to thereby alleviate safety hazards otherwise present in the form of obstructions on the pool bottom or walls.

Figure 5:
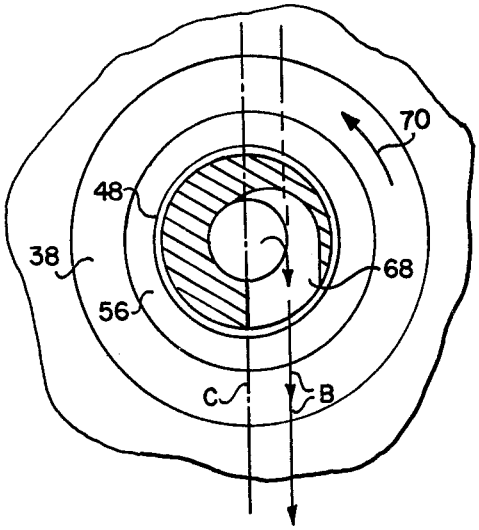
FIG. 5 is a fragmentary sectional view taken along line 5—5 of FIG. 3.
Figure 6:
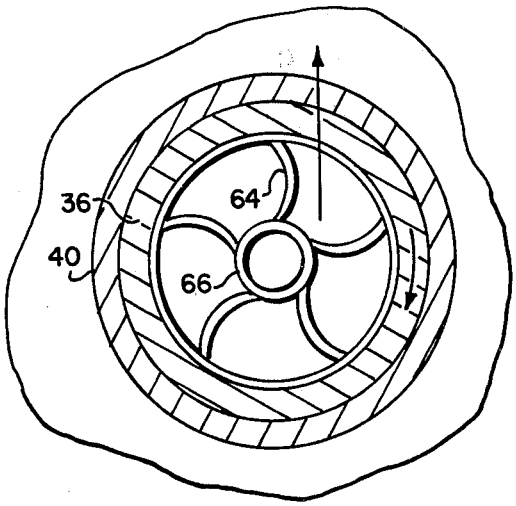
FIG. 6 is a fragmentary sectional view taken along line 6—6 of FIG. 2.
Figure 7:
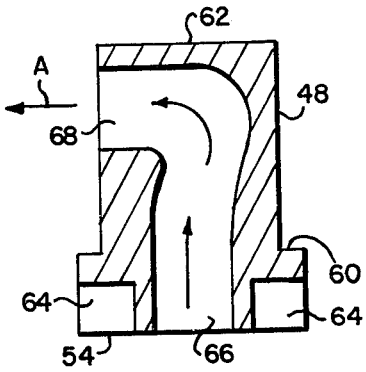
FIG. 7 is a sectional view taken along line 7—7 of FIG. 3 showing the jet rotated nozzle only and omitting details of its respective housing.

As shown in detail in FIGS. 2, 3, 5, 6 and 7, the nozzle 48 at its lower end is provided with jet reaction vanes 64 surrounding a central inlet 66 shown in detail in FIG. 7. Water in the housing interior 42 passes into the inlet 66 of the nozzle 48 and passes upwardly and outwardly through the jet reaction outlet 68 thereof. This jet reaction outlet 58 is eccentric with respect to the vertical axis of rotation 50 and, as shown in FIG. 7, is disposed substantially horizontally to deliver water in the direction of the arrow A in FIG. 7. Thus, water passes upwardly from the inlet 66 in a vertical direction and substantially horizontally from the jet reaction outlet 68 and substantially parallel to the lower surface 14 of the pool.

As shown in FIG. 5, the central axis of the jet reaction outlet 68 is represented by arrows B and these are offset from the center line C in FIG. 5; thus, water flowing from the jet reaction outlet 68 tends to rotate the respective nozzle 48 in the direction of the arrow 70. Additionally, the turbine-like vanes 64 tend to rotate the nozzle 48 in the same direction as indicated in FIG. 6 of the drawings.

As seen in FIGS. 5 and 6, the nozzle 48 is substantially circular in cross section and is disposed in the bore 46 of the housing 36; as indicated by flow arrows in FIG. 2 of the drawings, there is substantial clearance around the various features of the nozzle within the bore 46 so that water may flow around the nozzle 48 as it is forced upwardly as shown in FIG. 2 of the drawings. As it is energized by water pressure in the conduit 42, the nozzle moves from a position as shown in FIG. 4, upwardly, until the jet reaction nozzle outlet 68 emerges above the surface 14 of the pool at which time jet reaction causes rotation of the nozzle 48 while it is floating in the water bearing provided by the water surrounding the nozzle 48 in the housing. Thus, water is flowing all around the nozzle 56 as it moves upwardly and it is thereby floated in a water bearing as jet reaction from the jet outlet 68 causes rotation of the respective nozzle 48.

As the nozzle continues its upward movement, its stop ledge 60 engages the stop ledge 58 of the screw threaded ring 56 and at that time friction of the stop means limits rotation of the nozzle 48 and causes the nozzle to stop. However, during each upward movement of the nozzle 48, it rotates as schematically indicated by "sequence 1", "sequence 2", and "sequence 3", in FIG. 1 of the drawings.

Thus, each time a nozzle is energized, it extends from its housing and rotates during such extension. When the nozzle abuts its stop, the nozzle's upward and rotary motion is stopped to thereby leave the nozzle stationary with a strong stream of water issuing therefrom. When the nozzle is deenergized, it returns to its flush position. Subsequent energizations result in similar movement of the nozzle; since the stream of water issuing from the nozzle generally "fans out" as it travels further from the nozzle, and since the nozzle stops in a randomly different angular position each time it is energized, the streams overlap to clean the entire area surrounding the nozzle. Many factors contribute to the random nature of the rotation of the nozzles; it is believed that variations in supply water pressure, random flow disruptions, pool current variations, and other flow variations all contribute to the random rotation of the nozzles.

For example, the first energization of a nozzle 16 may result in a stream issuing therefrom generally in a direction identified in FIG. 1 as "sequence 1"; the second energization may result in a stream directed as shown by "sequence 2". After several such energizations, the pool area being cleaned by the stream issuing from the nozzle will have overlapped the pool area previously cleaned by that same stream. Thus, each time the sequencing valve 26 energizes a pair of the nozzles 48 through one of the conduits 18 to 24, the respective nozzles 48 are rotated. It will be understood that only two nozzles 48 are energized at one time, thereby taking the full flow and pressure from the pump 30 which causes very powerful jet action to be projected along the bottom of the pool and up the sides thereof and to thereby cause very efficient removal of sediment from the bottom of the pool. The sediment and foreign matter is suspended in the water so that it may be returned to the pump through the conduit 32 and deposited in the filter 28 before the water is again conducted through the sequencing valve 26.

We claim:

1. A system for cleaning the inner surfaces of a swimming pool, said pool having means for introducing water under pressure into said pool, means for withdrawing water containing suspended deleterious matter from said pool and conducting said water to a filter where said suspended deleterious matter is separated from said water, and means for returning said filtered water from said filter to said pool, said system comprising a water delivery assembly located upon the inner surface of said swimming pool, said assembly comprising:

(a) a housing in fluid communication with a source of water under pressure, said housing having an outer open end communicating with the interior of said swimming pool;

(b) a rotatable water delivery head formed as a single moving part having an upper end and at least one water aperture therein to project a pressurized stream of water in adjacent parallel and scrubbing relation to the inner surface of said pool, said delivery head being mounted in said housing and adapted for reciprocal motion therewithin to an extended operative position and a retracted inoperative position, said delivery head also adapted for limited random rotation only when positioned between said extended operative position and said retracted inoperative position;

(c) said water delivery head responsive to the application of pressurized water to said housing for extending non-rotational to said extended operative position; said head also responsive to the removal of pressure from the water in said housing for retraction to said retracted inoperative position;

(d) means responsive to the application of pressurized water to said housing for rotating said delivery head a randon angular distance during movement between its retracted inoperative position and extended operative position; and (e) means for stopping rotation of said delivery head when it is in its extended operative position to permit the projection therefrom of a pressurized stream of water, in a random direction, of sufficient velocity to clean the inner surface of said pool, said means for stopping said rotation comprising a radially extending collar on said delivery head, and an annular ledge in said housing, friction means on said collar and ledge coming into contact with each other when said head is in said extended position to stop rotation of said rotatable water delivery head.

2. A system for cleaning the inner surface of a swimming pool as set forth in claim 1 including a plurality of water delivery assemblies located at spaced points upon the inner surface of said swimming pool.

3. The system of claim 2 including means for sequentially applying said water under pressure to said water delivery assemblies to thereby extend the delivery heads of only a predetermined number of said delivery assemblies at any given time.

4. The swimming pool cleaning system of claim 2 wherein said means for causing said delivery head to rotate includes the stream of water projected from said delivery head, said stream of water directed from said delivery head from a position offset with respect to an axis of rotation of said head to cause a jet reaction urging said head to rotate about said axis.

5. The pool cleaning system of claim 2 wherein each of said water delivery assemblies includes a water flow path surrounding said delivery head and forming a water bearing between said head and said housing, said water flow path existing only when said head is between said extended and retracted positions.

6. The pool cleaning system of claim 4 wherein each of said water delivery assemblies includes a water flow path surrounding said delivery head and forming a water bearing between said head and said housing, said water flow path existing only when said head is between said extended and retracted positions.

* * * * *

UNITED STATES PATENT AND TRADEMARK OFFICE

CERTIFICATE OF CORRECTION

PATENT NO. : 4,212,088

DATED : July 15, 1980

INVENTOR(S) : John M. Goettl/George J. Ghiz

It is certified that error appears in the above-identified patent and that said Letters Patent are hereby corrected as shown below:

Column 6, line 16, cancel beginning with "(c) said water delivery head" to and including "to said retracted inoperative position;" at column 6, line 22, and insert the following text for subparagraph (c) of Claim 1:

--said water delivery head responsive to the application of pressurized water to said housing for extending to said extended non-rotational operative position; said head also responsive to the removal of pressure from the water in said housing for retraction to said retracted inoperative position;--

Signed and Sealed this

*Fifteenth* Day of *September 1981*

[SEAL]

*Attest:*

GERALD J. MOSSINGHOFF

*Attesting Officer*

*Commissioner of Patents and Trademarks*

REEXAMINATION CERTIFICATE (826th)

United States Patent [19]

Goettl et al.

[11] B1 4,212,088

[45] Certificate Issued Mar. 29, 1988

[54] APPARATUS FOR CLEANING SWIMMING POOLS

[75] Inventors: John M. Goettl, Phoenix, Ariz.; George J. Ghiz, 4736 E. Palo Verde, Phoenix, Ariz. 85018

[73] Assignee: George J. Ghiz, Phoenix, Ariz.

Reexamination Request:
No. 90/000,763, Jul. 25, 1985

Reexamination Certificate for:

| | |
|---|---|
| Patent No.: | **4,212,088** |
| Issued: | **Jul. 15, 1980** |
| Appl. No.: | **907,113** |
| Filed: | **May 18, 1978** |

Certificate of Correction issued Sep. 15, 1981.

Related U.S. Application Data

[60] Division of Ser. No. 832,464, Sep. 12, 1977, abandoned, which is a continuation-in-part of Ser. No. 616,677, Sep. 25, 1975, abandoned.

[51] Int. Cl.[4] ..... E04H 3/20; E08B 3/02; A01G 25/02; B05B 15/10

[52] U.S. Cl. ..... 4/490; 134/167 R; 239/66; 239/204

[58] Field of Search ..... 4/490

[56] References Cited

U.S. PATENT DOCUMENTS

| | | | |
|---|---|---|---|
| 1,144,619 | 6/1915 | Snyder . | |
| 1,964,269 | 1/1934 | Munz | 299/18 |
| 2,278,976 | 4/1942 | Crume | 299/61 |
| 2,989,246 | 6/1961 | Sloane | 239/204 |
| 3,127,110 | 3/1964 | Reynolds | 239/204 |
| 3,237,866 | 3/1966 | Lovell | 239/204 |
| 3,317,144 | 5/1967 | Muschett | 239/204 |
| 3,408,006 | 10/1968 | Stanwood | 239/97 X |
| 3,449,772 | 6/1969 | Werner | 134/167 R X |
| 3,506,489 | 4/1970 | Baker | 210/169 X |
| 3,747,129 | 7/1973 | Dyar | 4/1 |
| 3,770,203 | 11/1973 | Dyar | 239/205 |

*Primary Examiner*—Charles E. Phillips

[57] ABSTRACT

The disclosure relates to a method and apparatus for swimming pool cleaning incorporating intermittent pop-up jet rotated nozzles; the nozzles being adapted to intermittently rotate and project cleaning jets of water adjacent said inner surface. The nozzles each have eccentrically positioned tangential water outlets forming jet outlet passages; the nozzles are vertically reciprocal and are rotatably mounted in housings having stop means such that when they are hydraulically energized by water under pressure in the housings, the nozzles emerge from the upper ends of the housings and cause jet reaction rotation thereof during upward movement which is arrested by the stop means in the housing. The housing includes a bore with clearance around the nozzle so as to provide a water bearing around the nozzle during its upward and rotative movement. A plurality of such nozzles are disposed in a swimming pool and the nozzles are successively and sequentially hydraulically energized by water under pressure from a sequencing valve which receives water from a water pump which in turn receives water from the pool.

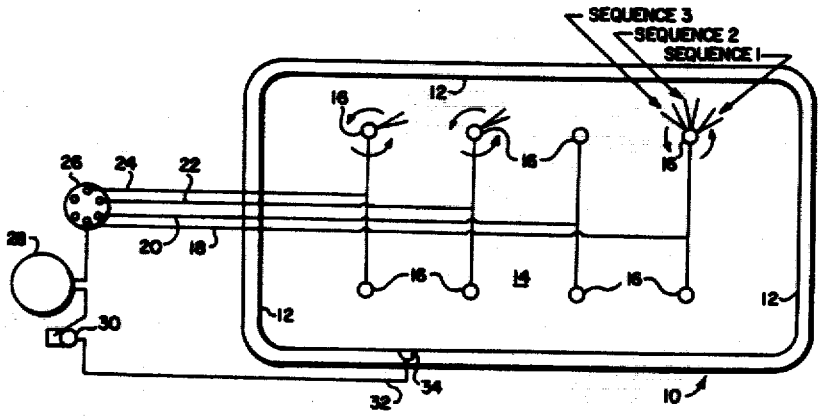

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 is confirmed.

* * * * *